US012557887B2

(12) United States Patent
Wulff et al.

(10) Patent No.: US 12,557,887 B2
(45) Date of Patent: Feb. 24, 2026

(54) ACCESSORY DEVICE WITH CONCEALED INTERNAL BUTTONS FEATURES

(71) Applicant: Apple Inc., Cupertino, CA (US)

(72) Inventors: Timothy C. Wulff, Boulder, CO (US); Joshua A. Hoover, Boulder, CO (US); Joshua Siu, Fremont, CA (US); Daniel J. Hagewood, Boulder, CO (US); Yue Liang, Shenzhen (CN); Stephen T. Schooley, Menlo Park, CA (US); Nishant R. Jayant, San Francisco, CA (US); Chengrui Zhang, San Jose, CA (US); Mengshen Wu, Wuhan (CN)

(73) Assignee: Apple Inc., Cupertino, CA (US)

( * ) Notice: Subject to any disclaimer, the term of this patent is extended or adjusted under 35 U.S.C. 154(b) by 196 days.

(21) Appl. No.: 18/427,687

(22) Filed: Jan. 30, 2024

(65) Prior Publication Data

US 2025/0082078 A1 Mar. 13, 2025

Related U.S. Application Data

(60) Provisional application No. 63/537,802, filed on Sep. 11, 2023.

(51) Int. Cl.
*A45C 11/00* (2006.01)

(52) U.S. Cl.
CPC ..... *A45C 11/00* (2013.01); *A45C 11/002* (2025.01); *A45C 11/003* (2025.01)

(58) Field of Classification Search
CPC ..... A45C 11/00; A45C 11/002; A45C 11/003
(Continued)

(56) References Cited

U.S. PATENT DOCUMENTS 7,623,898 B2 * 11/2009 Holmberg ..... H04B 1/3888 455/575.8
8,498,103 B2 * 7/2013 Graneto, III ..... G06F 1/1656 361/679.55

(Continued)

FOREIGN PATENT DOCUMENTS

CN 108347510 A 7/2018
CN 209002047 A 6/2019
CN 212627987 A 2/2021

OTHER PUBLICATIONS

Japanese Patent Application No. 2024-145775; Office Action dated Jul. 18, 2025, 9 pages with machine translation.

(Continued)

*Primary Examiner* — Jacob K Ackun
(74) *Attorney, Agent, or Firm* — BAKERHOSTETLER

(57) ABSTRACT

An accessory device with a button includes modifications and features to conceal internal features of the button as well as block light from passing through some locations of the button. The button may include several pillars and a compressible member between the pillars. The compressible member may conform to the shape of the pillars. In some exemplary implementations, the button may further include a seal that extends around the perimeter of the button to conceal internal features of the button. Additionally, the button may include extensions that further conceal internal components. Still further, the button may include an anti-reflective coating. Modifications to a sidewall may include a compressible member that inclines toward the button and/or an elevated lip used in conjunction with the extension of the button to conceal internal features.

20 Claims, 10 Drawing Sheets

(58) Field of Classification Search
USPC ..... 206/320
See application file for complete search history.

(56) References Cited

U.S. PATENT DOCUMENTS

| | | | | |
|---|---|---|---|---|
| 2011/0000775 | A1* | 1/2011 | Itou | H01H 13/705 200/520 |
| 2015/0068934 | A1* | 3/2015 | Armstrong | A45C 11/00 206/320 |
| 2015/0068935 | A1* | 3/2015 | Kay | H05K 5/061 206/320 |
| 2017/0364161 | A1* | 12/2017 | Lee | G06F 3/0446 |
| 2022/0158681 | A1* | 5/2022 | Fathollahi | H04B 1/3888 455/575.8 |
| 2024/0164166 | A1* | 5/2024 | Kubota | H10F 30/20 |

OTHER PUBLICATIONS

Korean Patent Application No. 10-2024-0121518; Office Action dated Oct. 22, 2025, 13 pages with English language translation.

* cited by examiner

ACCESSORY DEVICE WITH CONCEALED INTERNAL BUTTONS FEATURES

CROSS REFERENCE TO RELATED APPLICATIONS

This application claims the benefit of U.S. Provisional Application No. 63/537,802, entitled "ACCESSORY DEVICE WITH CONCEALED INTERNAL BUTTONS FEATURES," filed Sep. 11, 2023, the entirety of which is incorporated herein by reference.

TECHNICAL FIELD

This application is directed to buttons for devices, and more particularly, to buttons that are indirectly coupled with an accessory device and include modifications to hide internal features of the button.

BACKGROUND

Accessory devices (e.g., cases) for electronic devices include buttons that are positioned in locations corresponding to electronic device buttons. When a button is in a resting, or unactuated, position, some internal features (e.g., button pillars) of the button may be visible in some locations across the distribution. As a result, users may be permitted to see the internal features, thus reducing the overall aesthetics of the accessory device. One solution is to provide a thicker wall for the accessory device. However, this may impede the minimum travel needed on the accessory device button for desired functionality (e.g., to actuate an electronic device button).

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject technology is directed to accessory devices and buttons for accessory devices. A "button" shown and/or described herein may include a push button, touch sensor, or the like capable of operating (e.g., actuating) a switch, trigger, or other similar function of an electronic device. More particularly, the subject technology is directed to buttons that are indirectly coupled with accessory devices. The phrase "indirectly coupled" may refer to an intervening structure, or assembly of structures, that couples to both a button and accessory device such that the button is a "floating" button that is not physically contacting the accessory device, including a wall (e.g., sidewall) of the accessory device. As a non-limiting example, buttons described herein may be indirectly coupled to accessory devices by a plate (e.g., weld plate).

Additionally, the subject technology is directed to modifying buttons and/or accessory devices in order to hide, conceal, or otherwise obscure internal features of the button. For example, a button may include multiple pillars and a compressible member (e.g., foam) between adjacent pillars. The compressible member conforms to the shape of the pillars and prevents light leakage through the button, while minimizing unwanted movement of the button. In other exemplary implementations, the accessory device may include a compressible layer positioned on a sidewall. The compressible layer may form an incline at or near the button, thereby reducing the space between the button and the accessory device. Beneficially, the modifications to buttons and/or accessory devices described herein may focus a user's attention on the exterior aesthetic features of an accessory device, while focusing the user's attention away from internal features.

These and other embodiments are discussed below with reference to FIGS. 1-12. However, those skilled in the art will readily appreciate that the detailed description given herein with respect to these Figures is for explanatory purposes only and should not be construed as limiting.

Figure 1:
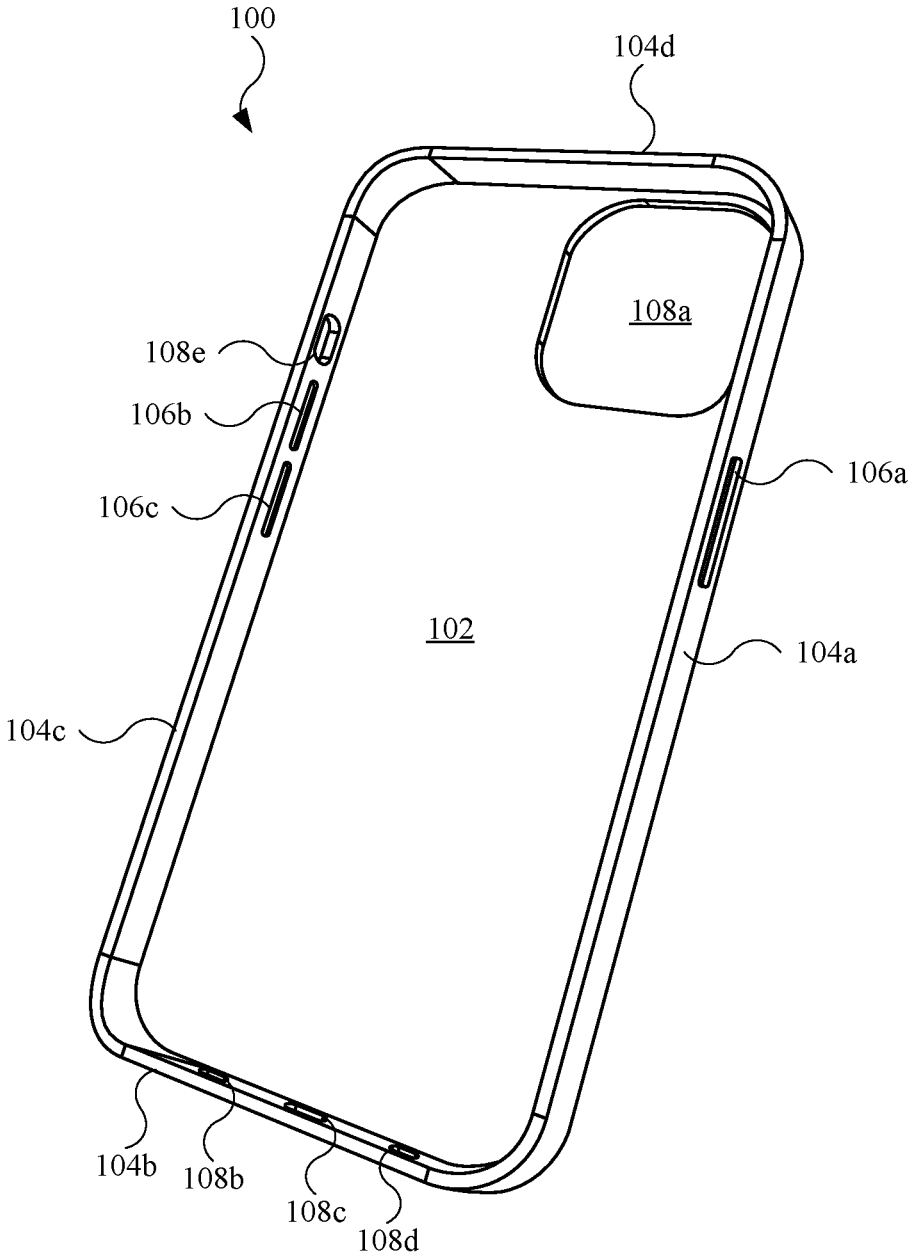
FIG. 1 illustrates a perspective view of an example of an accessory device, in accordance with aspects of the present disclosure.

FIG. 1 illustrates a perspective view of an accessory device 100, in accordance with aspects of the present disclosure. Accessory device 100 may take the form of a case or protective cover for mobile wireless communication devices, including electronic devices such as smartphones and tablet computing devices, as non-limiting examples. As shown, accessory device 100 includes a wall 102. Wall 102 may be referred to as a bottom wall or back wall. Accessory device 100 may further include several walls extending from wall 102. For example, accessory device 100 may include a wall 104*a*, a wall 104*b*, a wall 104*c*, and a wall 104*d*. Each of walls 104*a*, 104*b*, 104*c*, and 104*d* may be referred to as a sidewall. Collectively, wall 102 and walls 104*a*, 104*b*, 104*c*, and 104*d* combine to form an internal volume, or space, to receive a mobile wireless communication device. Also, in one or more implementations, wall 102 and walls 104*a*, 104*b*, 104*c*, and 104*d* may include a textile layer formed from woven fabric or knitted fabric, as non-limiting examples.

Accessory device 100 may include several features designed to accommodate one or more features of a mobile wireless communication device. For example, accessory device 100 may include a button 106*a*, a button 106*b*, and a button 106*c*, each of which being designed to be actuated/depressed and move relative to a wall on which each of buttons 106*a*, 106*b*, and 106*c* are located. For example, button 106*a*, located on wall 104*a*, is designed to move relative to wall 104*a*. Also, when a mobile wireless communication device is positioned in accessory device 100, each of buttons 106*a*, 106*b*, and 106*c* may align with a respective button of the mobile wireless communication device. In this regard, actuation of button 106*a* (representative of buttons 106*b* and 106*c*) may result in actuation of an electronic device button aligned with button 106*a*. While button 106*a* is positioned on wall 104*a* and buttons 106*b* and 106*c* are positioned on wall 104*c*, buttons 106*a*, 106*b*, and 106*c* may be positioned on other walls. Generally, the number and location of the buttons of accessory device 100 may correspond to the number and location, respectively, of buttons on a mobile wireless communication device.

Accessory device 100 may include several additional features designed to accommodate a mobile wireless communication device. For example, accessory device 100 may include several openings to enable unimpeded access to ambient environment for input/output functionality for such features as images sensors (e.g., camera), camera flash, or the like, as well as unimpeded access to sensors of the electronic devices including but not limited to sound, light, temperature, pressure, etc., input/output ports for wired or direct contact communication of data and/or power such as through a connector or surface contact. Additionally, openings of accessory device 100 may enable access to any other portion or part of the electronic device enhanced by undamped, unmuffled, or otherwise un-occluded access to ambient conditions for optimal performance. As shown, accessory device 100 may include an opening 108*a* formed in wall 102. Opening 108*a* may accommodate one or more cameras, a camera flash, and/or a microphone of a mobile wireless communication device. Accessory device 100 may further include an opening 108*b*, an opening 108*c*, and an opening 108*d* formed in wall 104*b*. Each of openings 108*b*, 108*c*, and 108*d* may align with a feature of a mobile wireless communication device, such as one or more audio transducers (e.g., speaker, microphone) and/or a port used for charging a battery of the mobile wireless communication device and/or data communication to/from the mobile wireless communication device. Accessory device 100 may further include an opening 108*e* formed in wall 104*c*. Opening 108*e* may accommodate a switch (e.g., slider switch) of a mobile wireless communication device. While openings 108*a*, 108*b*, 108*c*, 108*d*, and 108*c* are shown in discrete locations, openings 108*a*, 108*b*, 108*c*, 108*d*, and 108*e* may be generally located anywhere on accessory device 100 to accommodate a feature of a mobile wireless communication device.

Figure 2:
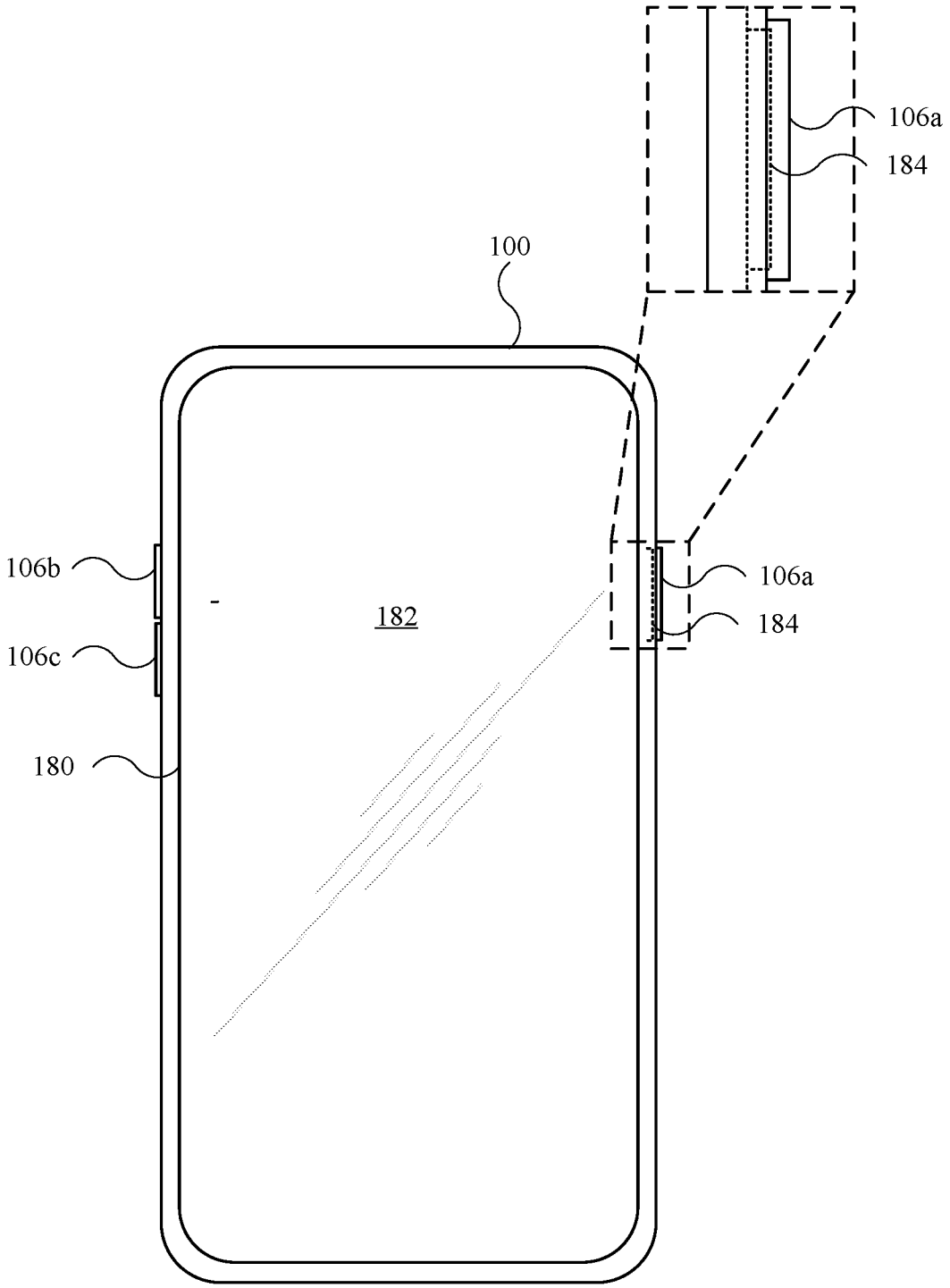
FIG. 2 illustrates a plan view of an accessory device and an electronic device positioned in the accessory device, in accordance with aspects of the present disclosure.

FIG. 2 illustrates a plan view of accessory device 100 and an electronic device 180 positioned in accessory device 100, in accordance with aspects of the present disclosure. Electronic device 180 may take the form of a mobile wireless communication device. Electronic device 180 may include a display 182 designed to present visual content (e.g., textual information, still images, motion images). Electronic device 180 may further include a button 184 designed to allow a user to interact with display 182 by for example, selecting an option presented on display 182, altering visual content on display 182, and/or activating/deactivating display 182. As shown in the enlarged view, button 106*a* of accessory device 100 is in a corresponding location as that of button 184. Accordingly, button 106*a* is aligned with, and covers, button 184, and actuation of button 106*a* may result in a corresponding actuation of button 184. Although not expressly shown, electronic device 180 may include two additional button, and buttons 106*b* and 106*c* of accessory device 100 may be in a corresponding location of a respective button of the two buttons.

Figure 3:
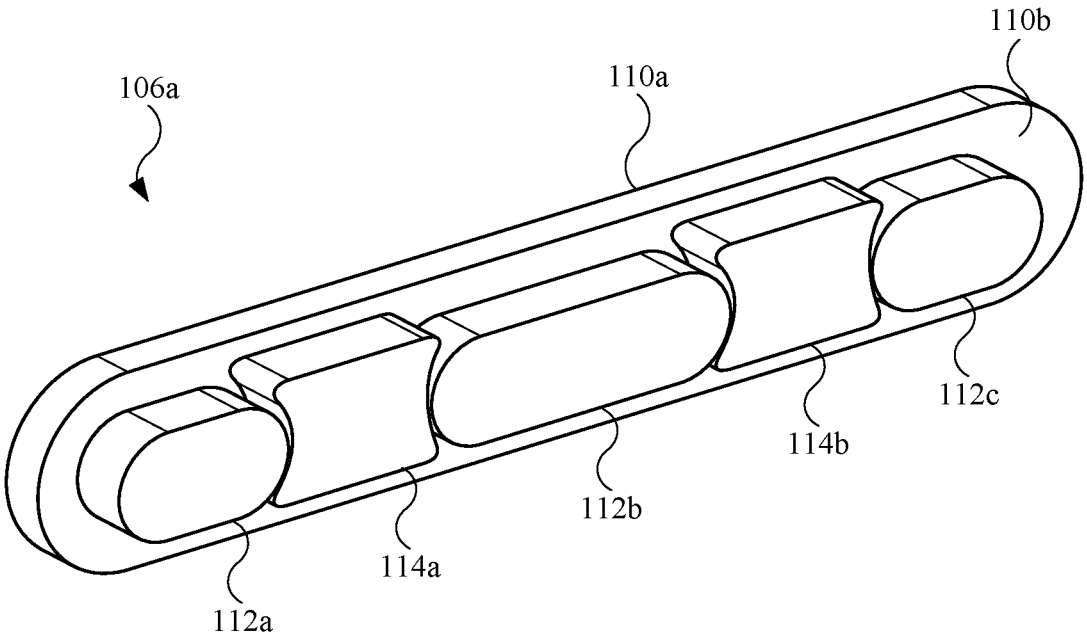
FIG. 3 illustrates a perspective view of an example of a button, in accordance with aspects of the present disclosure.

FIG. 3 illustrates a perspective view of button 106*a*, in accordance with aspects of the present disclosure. Button 106*a* may be formed from a variety of materials. For example, in one or more implementations, button 106*a* is formed from a metal (e.g., aluminum, stainless steel, or an alloy that includes aluminum or stainless steel). Button 106*a* may include a surface 110*a*. When button 106*a* is integrated with an accessory device (e.g., accessory device 100 shown in FIG. 1), surface 110*a* represents an exterior surface with which a user may interact. Button 106*a* may further include a surface 110*b* that is opposite surface 110*a*. Based on surfaces 110*a* and 110*b* being part of button 106*a*, each of surfaces 110*a* and 110*b* may be referred to as a button surface. When button 106*a* is integrated with an accessory device, surface 110*b* represents an interior surface. Button 106*a* may further include several pillars. For example, button 106*a* may include a pillar 112*a*, a pillar 112*b*, and a pillar 112*c*, each of which is extending from surface 110*b*. Pillars 112*a*, 112*b*, and 112*c* may represent extensions, or columns, of button 106*a* used with actuating a mobile wireless communication device button (not shown in FIG. 3). In one or more implementations, each of pillars 112*a*, 112*b*, and 112*c* is formed in a lozenge shape. However, other shapes are possible. The size and/or shape of pillars 112*a*, 112*b*, and 112*c* vary in accordance with the corresponding button or sensor of an electronic device, and in particular, may vary in accordance with function of the corresponding button or sensor of the electronic device by which button 106*a* may actuate or trigger. Also, while pillars 112*a*, 112*b*, and 112*c* generally include the same shape, pillar 112*b* (located between pillars 112*a* and 112*c*) may include a size and volume that is greater than the size and volume, respectively, of each of pillars 112*a* and 112*c*. Also, while pillars 112*a*, 112*b*, and 112*c* represent three pillars of button 106*a*, the number of pillars may vary. For example, in one or more implementations, two pillars extend from button 106*a*.

Several compressible members may be integrated with button 106*a* between adjacent or consecutive pillars. For example, a compressible member 114*a* may be positioned between pillars 112*a* and 112*b*, and a compressible member 114*b* may be positioned between pillars 112*b* and 112*c*. In one or more implementations, each of compressible members 114*a* and 114*b* includes a foam. In this regard, compressible members 114*a* and 114*b* may be designed to deform in response to an applied force. When button 106*a* is integrated with accessory device 100, each of compressible members 114*a* and 114*b* may limit or prevent movement of button 106*a* when accessory device 100 is shaken or suddenly moved. Beneficially, based on compressible members 114*a* and 114*b*, button 106*a*, which may be formed from a rigid material(s) (e.g. metal(s)), is less susceptible to rattling and causing unwanted noise.

Figure 4:
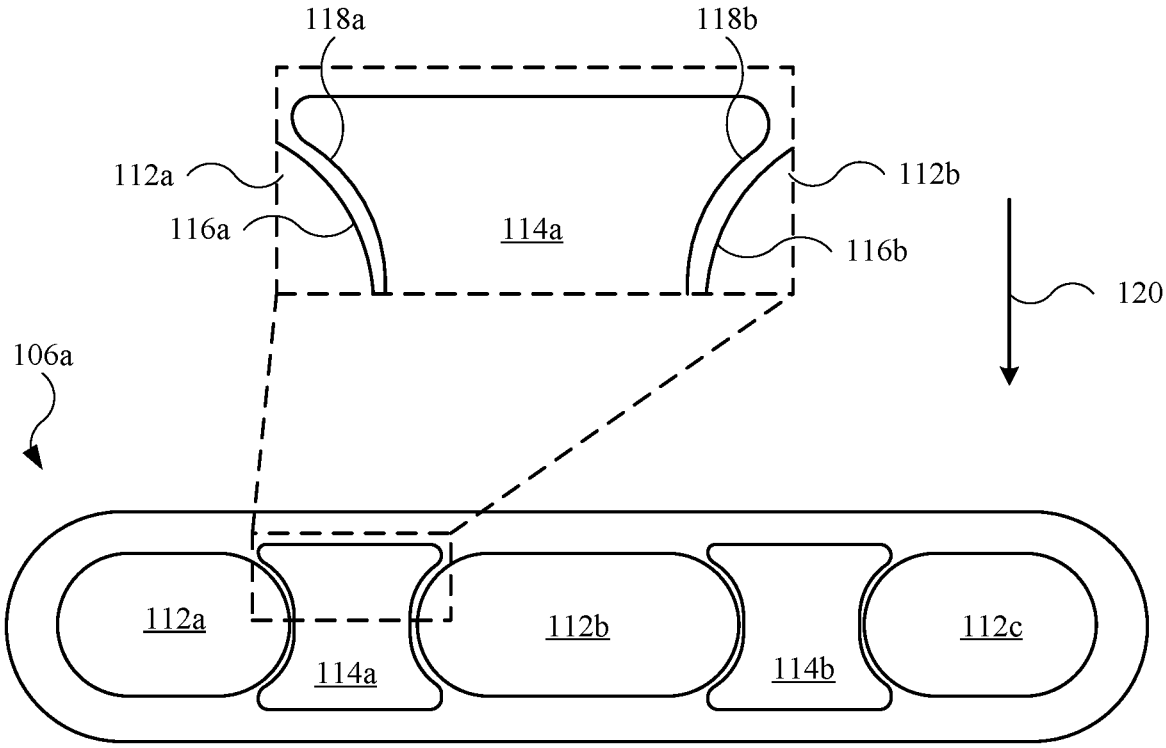
FIG. 4 illustrates a plan view of a button, further showing pillars of the button and compressible members in relation to the pillars, in accordance with aspects of the present disclosure.

FIG. 4 illustrates a plan view of button 106*a*, further showing pillars 112*a*, 112*b*, and 112*c* of button 106*a* and compressible members 114*a* and 114*b* in relation to pillars 112*a*, 112*b*, and 112*c*, in accordance with aspects of the present disclosure. In one or more implementations, the shape of each of the compressible members 114*a* and 114*b* conforms to, or accommodates, the shape of multiple pillars. For example, as shown in the enlarged view, each of pillar 112*a* and pillar 112*b* includes a convex surface 116*a* and a convex surface 116*b*, respectively. Accordingly, pillars 112*a* and 112*b* (as well as pillar 112*c*) may include at least one rounded corner. In order to conform to the respective shapes of pillars 112*a* and 112*b*, compressible member 114*a* includes a concave surface 118*a* and a concave surface 118*b* that conforms to convex surface 116*a* and convex surface 116*b*, respectively. Concave surfaces 118*a* and 118*b* of compressible member 114*a* may allow compressible member 114*a* to overlap, or at least partially overlap, each of pillars 112*a* and 112*b*. Compressible member 114*b* and pillars 112*b* and 112*c* may include similar relationships with respect to each other. In this regard, light travelling in a direction represented by an arrow 120 is blocked, or at least substantially blocked, from passing through button 106*a* between pillars 112*a*, 112*b*, and 112*c*.

Figure 5:
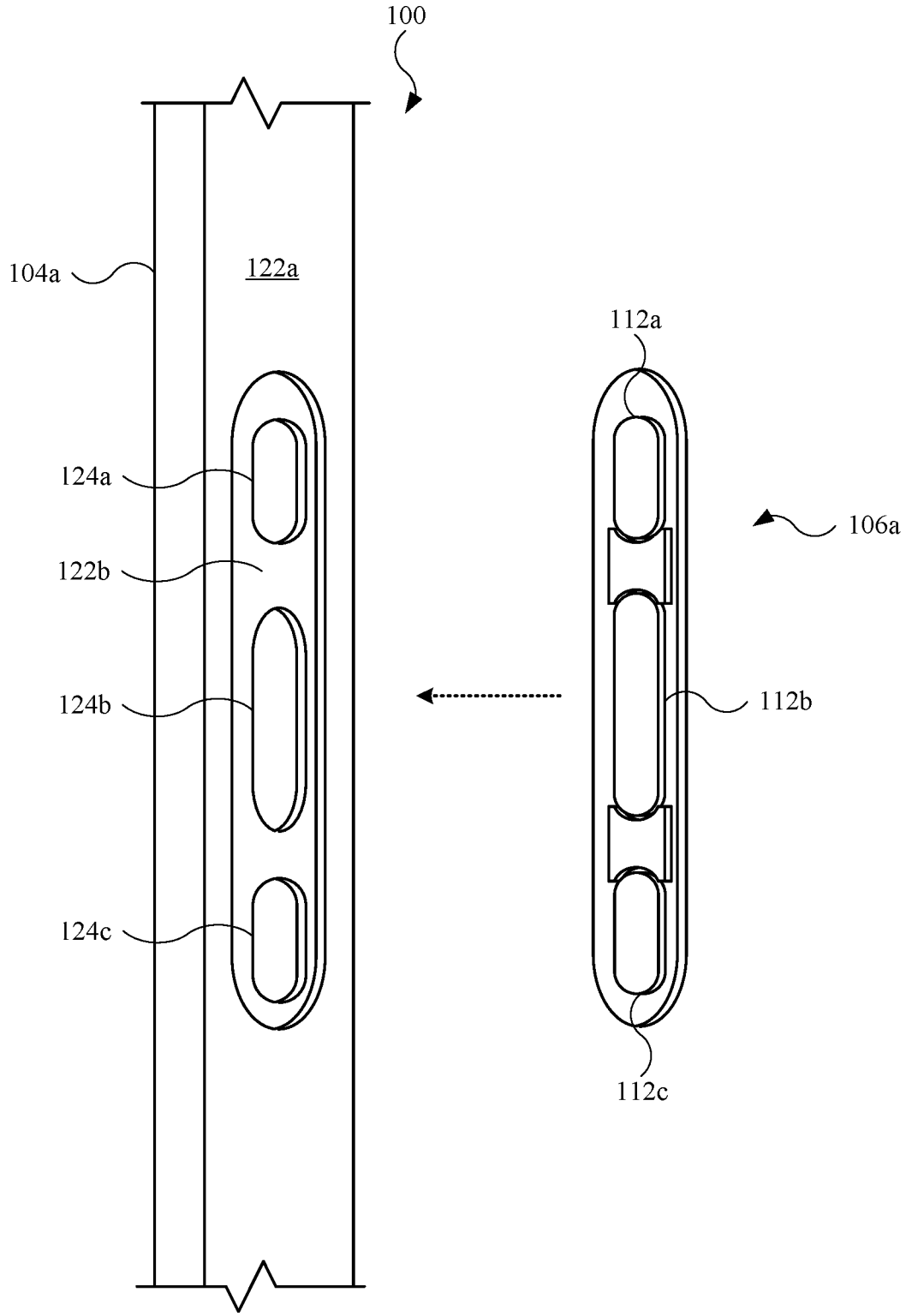
FIG. 5 illustrates a perspective view of a wall of an accessory device and a button designed to couple with the wall, in accordance with aspects of the present disclosure.

FIG. 5 illustrates a perspective view of wall 104*a* of accessory device 100 and button 106*a* designed to couple with the wall 104*a*, in accordance with aspects of the present disclosure. As shown, wall 104*a* includes a surface 122*a* and a surface 122*b*, with surface 122*b* being sub flush (e.g., below) with respect to surface 122*a*. Due in part to wall 104*a* being characterized as a sidewall, each of surfaces 122*a* and 122*b* may be characterized as a sidewall surface. Wall 104*a* may further include several openings formed through surface 122*b*. For example, wall 104*a* includes an opening 124*a*, an opening 124*b*, and an opening 124*c*. In one or more implementations, opening 124*a*, opening 124*b*, and opening 124*c* may include a size and shape to receive pillar 112*a*, pillar 112*b*, and pillar 112*c*, respectively. As a result, when button 106*a* is coupled with wall 104*a*, pillar 112*a*, pillar 112*b*, and pillar 112*c* are positioned, or at least partially positioned, in opening 124*a*, opening 124*b*, and opening 124*c*, respectively.

Figure 6:
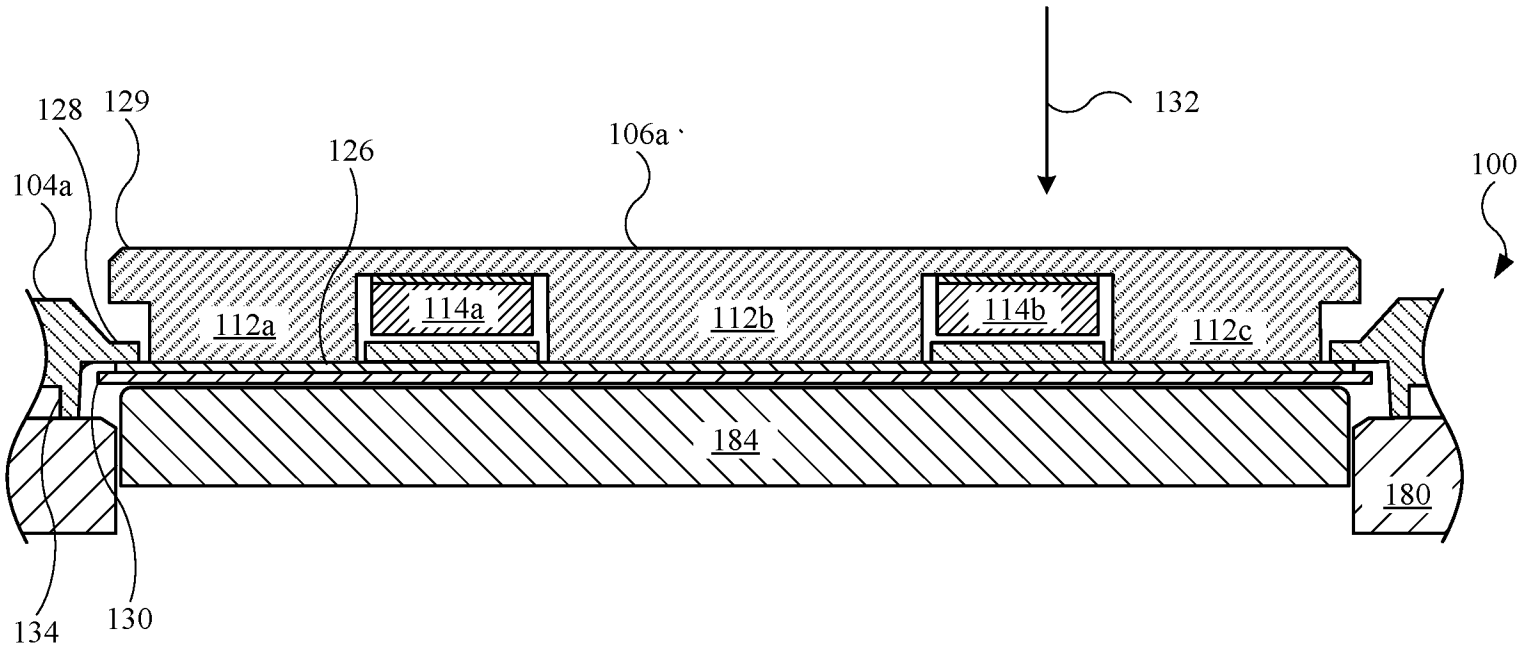
FIG. 6 illustrates a cross sectional view of a button coupled with a wall of an accessory device, in accordance with aspects of the present disclosure.

FIG. 6 illustrates a cross sectional view of button 106*a* coupled with wall 104*a* of an accessory device 100, in accordance with aspects of the present disclosure. Wall 104*a* may include one or more materials. For example, in one or more implementations, wall 104*a* includes a molded polymer shell. As a non-limiting example, the molded polymer shell may include polyester. Further, wall 104*a* may include a textile layer (e.g., woven fabric, knitted fabric) that covers the molded polymer shell. Also, compressible member 114*a* and 114*b* may be secured to button 106*a* by an adhesive (shown, not labeled).

Accessory device 100 may include a plate 126. In one or more implementations, plate 126 includes sheet metal. In order to secure button 106*a* to accessory device 100, plate 126 may be welded to button 106*a* and also coupled to wall 104*a* of accessory device 100 by, for example, an adhesive or ultrasonic welding. In this regard, plate 126 may take the form of a weld plate. Further, wall 104*a* may be modified to secure with plate 126. For example, wall 104*a* may include a lip 128 that extends around a perimeter of button 106*a*. Lip 128 may provide additional material that hides internal features of button 106*a*. As shown, lip 128 may provide a surface onto which plate 126 is secured and fixed to wall 104*a*. Also, button 106*a* may include an ledge 129 that extends around a perimeter of button 106*a*. As shown, ledge 129 may provide button 106*a* with additional structures that extends laterally beyond other features of button 106*a* (e.g., pillars 112*a*, 112*b*, and 112*c*). Based on lip 128 and ledge 129 extending toward each other, internal features of button 106*a* may further be hidden from view. In order to cover marks or other indications of a welding operation, plate 126 may be covered by a label 130.

As shown, button 106*a* of accessory device 100 is positioned over button 184 of electronic device 180. In this regard, when button 106*a* is actuated in a direction of an arrow 132, button 106*a* of may cause actuation of button 184. Further, in order to reduce a tolerance stack of accessory device 100 and/or electronic device 180, wall 104*a* may further include a standoff 134 that extends around a perimeter of button 106*a*. Beneficially, standoff 134 may allow wall 104*a* to include a relatively thin wall. Also, standoff 134 may also prevent button 184 from contacting accessory device 100 when extracting electronic device 180 from accessory device 100. As shown, standoff 134 is perpendicular, or at least substantially perpendicular, with respect to lip 128. Standoff 134 may include molded polymer or elastomer, as non-limiting examples.

FIGS. 7-11 show and/or describe alternate examples of accessory devices and/or features integrated with accessory devices. The accessory devices shown and/or described in FIGS. 7-11 may include at least some structures and associated features and functions of accessory device 100 (shown in FIGS. 1-6). Also, in one or more implementations, accessory device 100 may be modified to include at least some structures and associated features and functions of the accessory devices in shown and/or described FIGS. 7-11.

Figure 7:
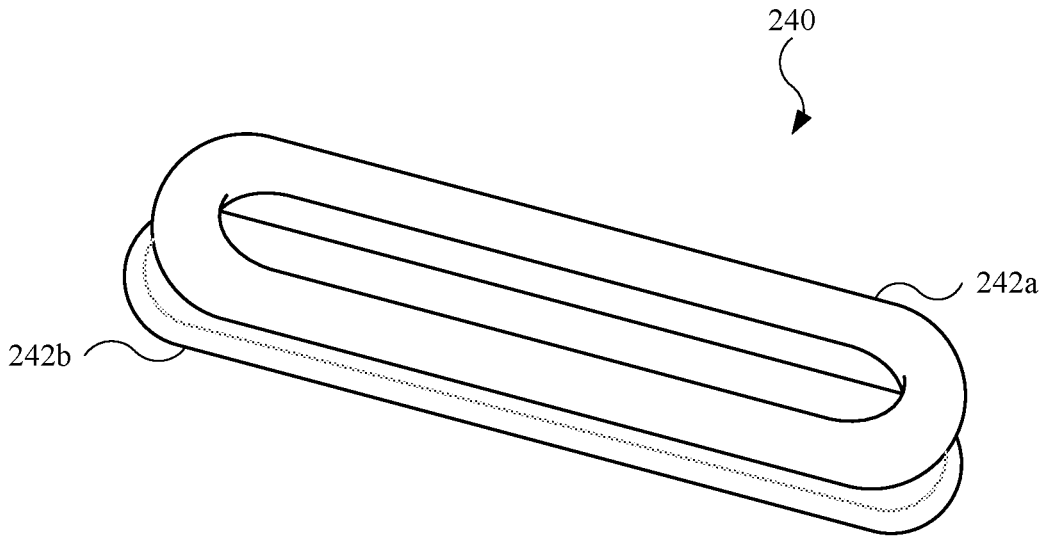
FIG. 7 illustrates a perspective view of a seal for use with a button, in accordance with aspects of the present disclosure.

FIG. 7 illustrates a perspective view of a seal 240 for use with a button, in accordance with aspects of the present disclosure. As shown, seal 240 may take the form of a ring or ring-like structure. Seal 240 may be formed from one or more compressible materials such as rubber, as a non-limiting example. As show, seal 240 includes a portion 242*a* and a portion 242*b*.

Figure 8:
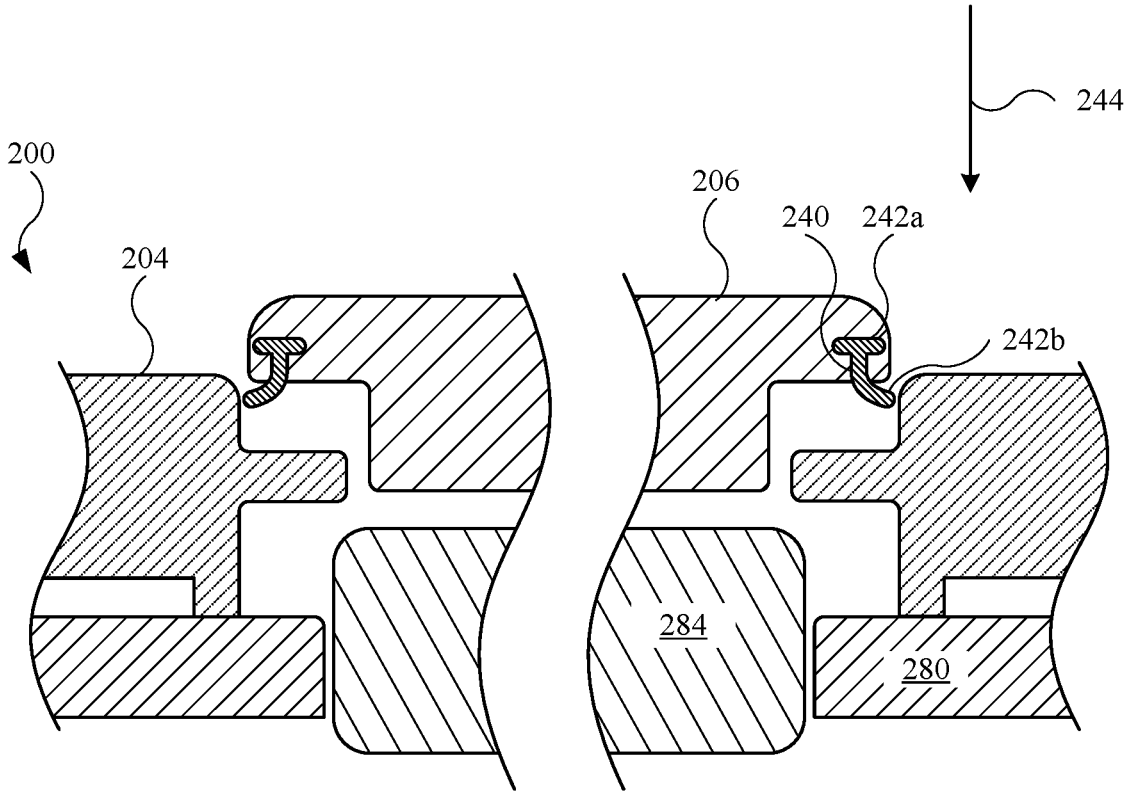
FIG. 8 illustrates a cross sectional view of an alternate example of a button for an accessory device, further showing a seal coupled to the button, in accordance with aspects of the present disclosure.

FIG. 8 illustrates a cross sectional view of an alternate example of a button 206 for an accessory device 200, further showing seal 240 coupled to button 206, in accordance with aspects of the present disclosure. As shown, portion 242*a* of seal 240 is positioned in a cavity (shown, not labeled) of button 206. The cavity may be formed by a cutting operation to button 206, such as a T-cutting operation, as a non-limiting example. Portion 242*b* may take the form of a tail that extends from button 206. Based on the position of seal 240, and in particular, the position of portion 242*b* of seal 240, seal 240 may prevent ingress of contaminants and/or liquid from reaching an electronic device 280 positioned in accessory device 200. Moreover, seal 240 may hide or obscure at least some internal features of accessory device 200 (e.g., internal features of button 206), thus reducing visibility of the internal features of accessory device 200.

As further shown, button 206 of accessory device 200 is aligned with a button 284 of electronic device 280. When button 206 is actuated in a direction of arrow 244, button 206 may cause a corresponding actuation of button 284. Although seal 240 moves with button 206 and may contact a wall 204 of accessory device 200, seal 240 may nonetheless compress and/or deform in response to contacting wall 204. Beneficially, seal 240 may be positioned relatively close to wall 204 without affecting travel of button 206. Also, button 206 and seal 240 may be formed from different materials. For example, button 206 may include a rigid material (e.g., metal), and seal 240 may include a non-rigid material (e.g., rubber).

Figure 9:
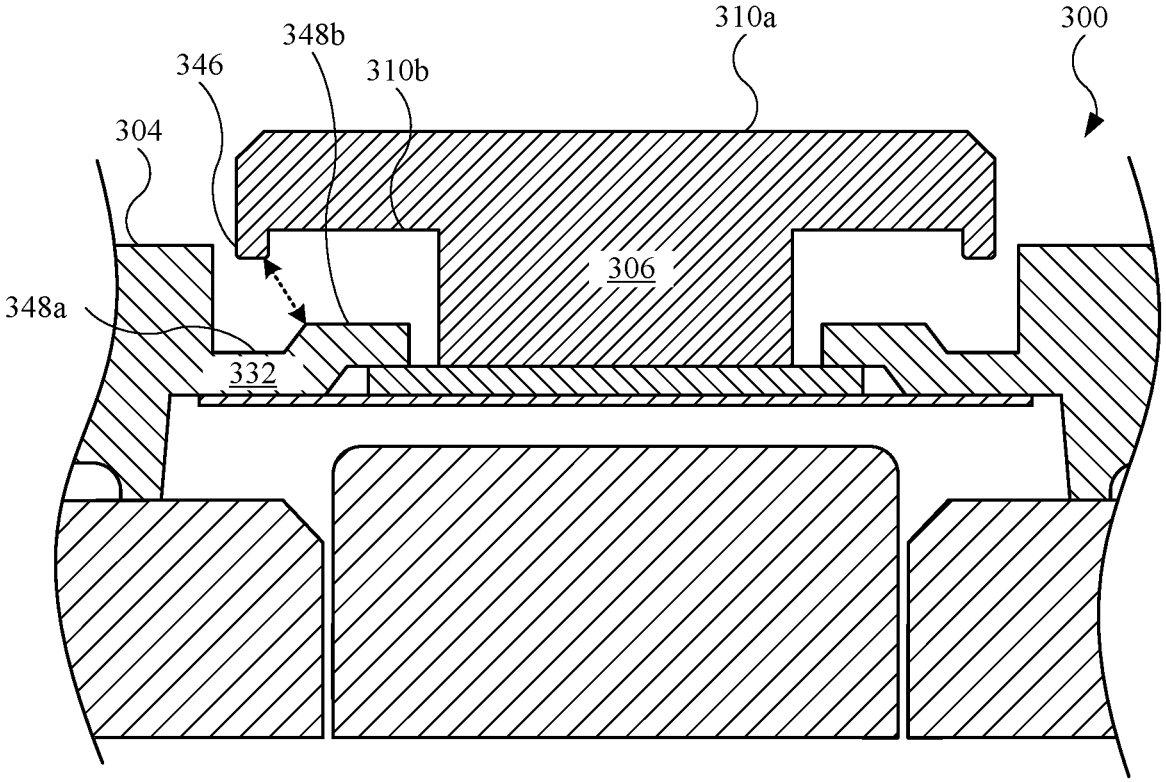
FIG. 9 illustrates a cross sectional view of an alternate example of a button for an accessory device, showing modifications to both the accessory device and the button, in accordance with aspects of the present disclosure.

FIG. 9 illustrates a cross sectional view of an alternate example of a button 306 for an accessory device 300, showing modifications to both accessory device 300 and button 306, in accordance with aspects of the present disclosure. As shown, button 306 includes a surface 310*a* and a surface 310*b* that is opposite surface 310*a*. Button 306 may further include an extension 346 that extends from surface 310*b*. Extension 346 may represent additional material of button 306 used to hide or obscure one or more internal features of button 306. Also, extension 346 may extend around a perimeter of button 306.

Accessory device 300 may include modifications to hide internal features of button 306. For example, accessory device 300 may include a wall 304 that includes a lip 332. As shown, lip 332 includes different sections with different elevations. For example, lip 332 may include a section 348*a* at an elevation and a section 348*b* at an elevation different from that of section 348*a*. As shown, section 348*b* is elevated (e.g., at a higher elevation) with respect to section 348*a*. Based on the position of section 348*b* of lip 332 relative to extension 346, a gap (represented by a two-sided arrow) may be smaller as compared to a gap of an accessory device with no extension or elevated section. Beneficially, the gap is smaller, thus further hiding one or more internal features of button 306.

Figure 10:
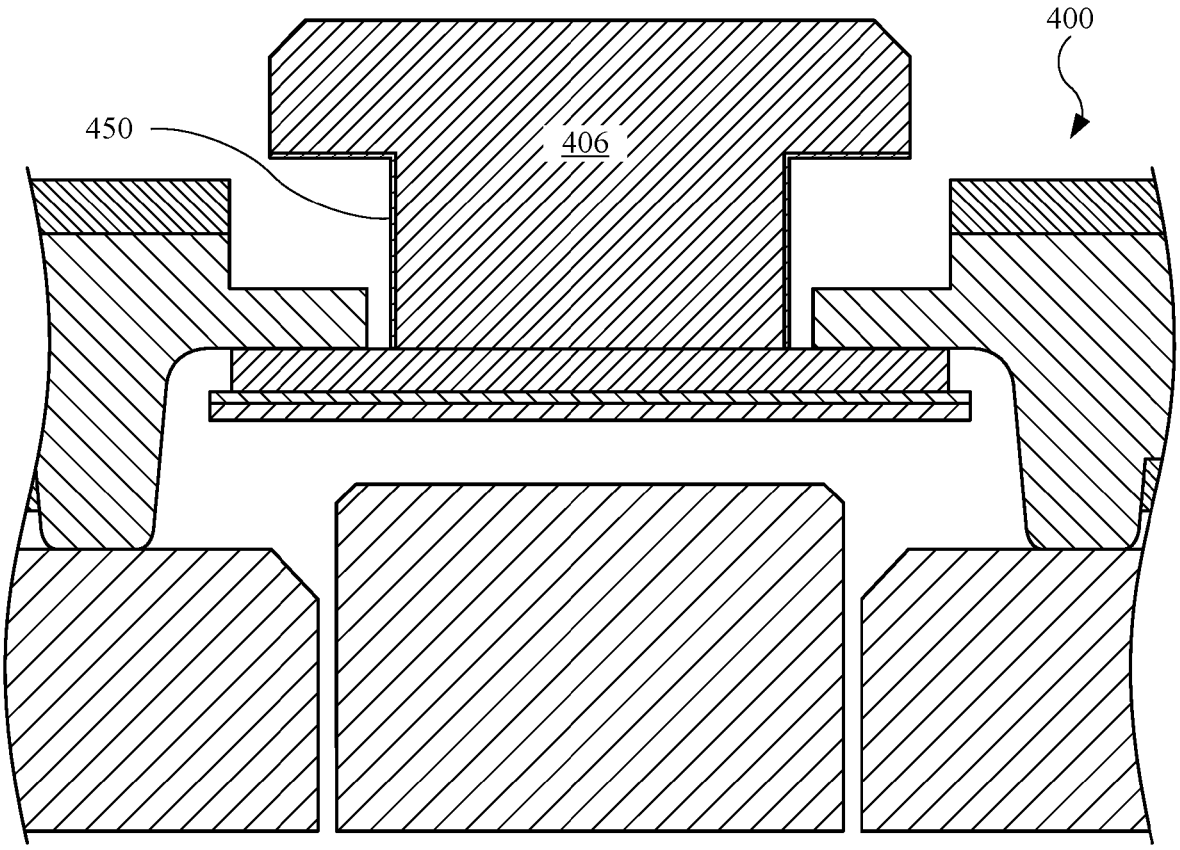
FIG. 10 illustrates a cross sectional view of an alternate example of a button for an accessory device, showing a coating applied to the button, in accordance with aspects of the present disclosure.

FIG. 10 illustrates a cross sectional view of an alternate example of a button 406 for an accessory device 400, showing a coating 450 applied to button 406, in accordance with aspects of the present disclosure. In one or more implementations, coating 450 includes an anti-reflective material designed to minimize reflection of light incident on coating 450. In this regard, coating 450 may include several small pores designed to receive and internally reflect the incident light. In one or more implementations, coating 450 includes a light-absorbing material designed to absorb light incident on coating 450. Accordingly, coating 450 may be referred to as a light-absorbing coating. Beneficially, implementations of coating 450 on button 406 may cause at least some internal features of button 406 to be less visible to a user of accessory device 400.

Figure 11:
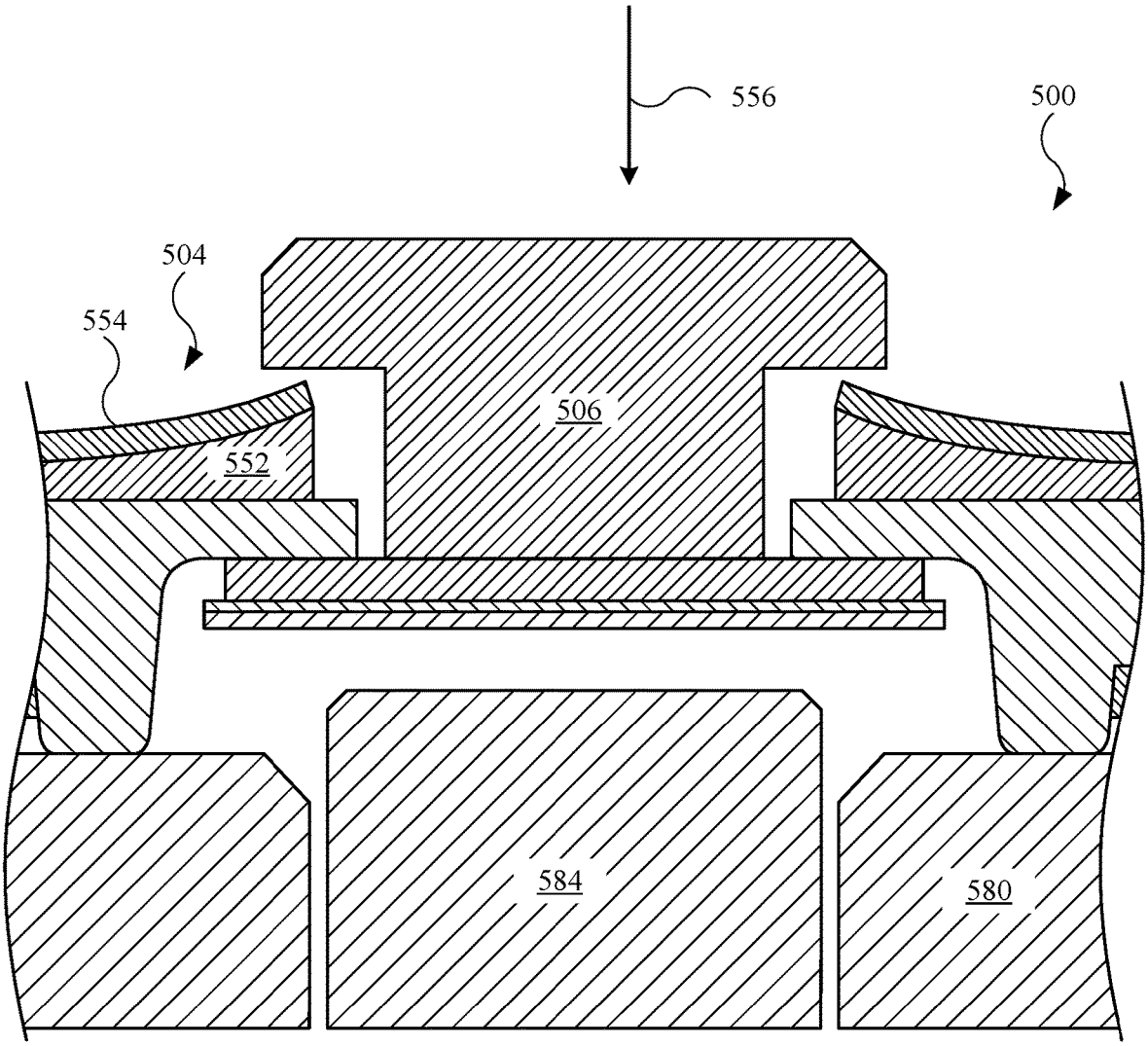
FIG. 11 illustrates a cross sectional view of an alternate example of a button for an accessory device, showing a compressible layer applied to the accessory device, in accordance with aspects of the present disclosure.

FIG. 11 illustrates a cross sectional view of an alternate example of a button 506 for an accessory device 500, showing a compressible layer 552 applied to accessory device 500, in accordance with aspects of the present disclosure. As shown, accessory device 500 includes a wall 504 that includes compressible layer 552 and a textile layer 554, with textile layer 554 covering compressible layer 552. In one or more implementations, compressible layer 552 includes a foam such as closed cell foam, as a non-limiting example. In one or more implementations, compressible layer 552 includes a rubber or plastic that includes a relatively low durometer. Compressible layer 552 may incline and change thickness (e.g., become thicker) at locations at or below button 506 (as oriented in FIG. 11). In this regard, a gap between button 506 and wall 504 may decrease, thus hiding at least some internal features of button 506. In one or more implementations, textile layer 554 includes a woven or knitted fabric.

Button 506 may be actuated in a direction of an arrow 556 to actuate a button 584 of an electronic device 580. As a result, button 506 may engage wall 504 (including textile layer 554). However, based on the material makeup, compressible layer 552 may compress and reduce in size, thus allowing button 506 to actuate button 584.

Figure 12:
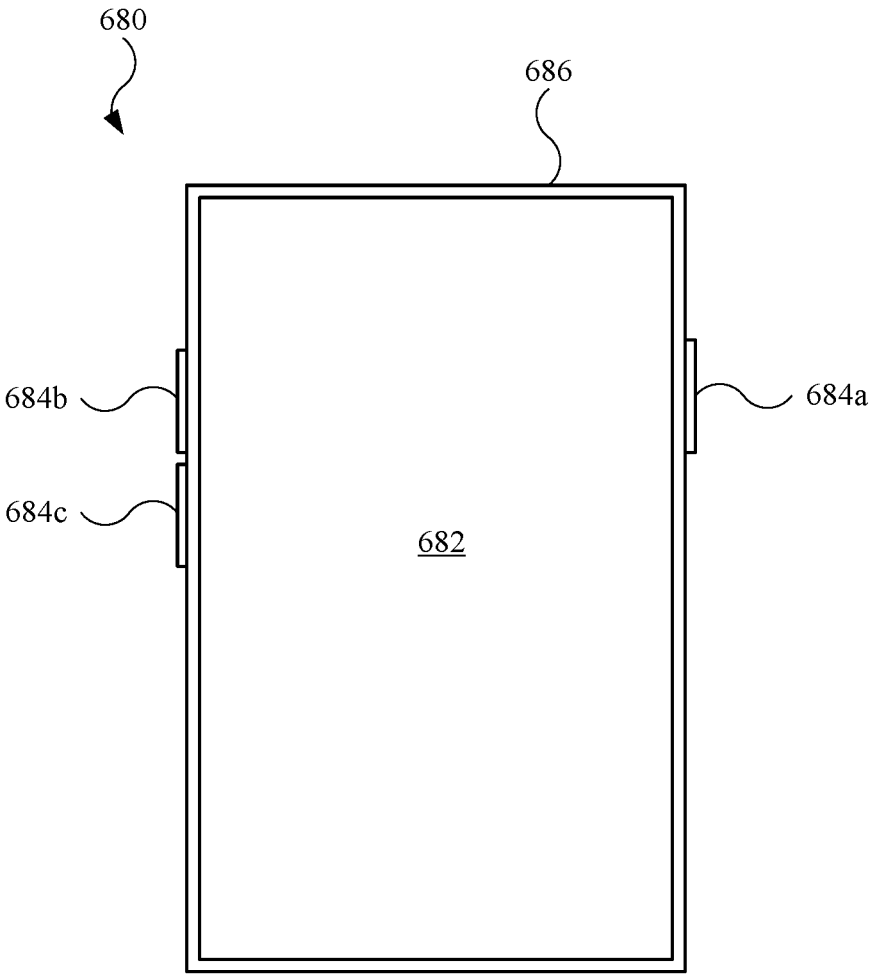
FIG. 12 illustrates a plan view of an electronic device, in accordance with aspects of the present disclosure.

FIG. 12 illustrates a plan view of an electronic device 680, in accordance with aspects of the present disclosure. Electronic device 680 may include a display 682 and an enclosure 686 coupled to display 682. Electronic device 680 may further include several buttons, such as a button 684*a*, a button 684*b*, and a button 684*c*. In one or more implementations, at least one of buttons 684*a*, 684*b*, and 684*c* includes one or more features of a button for an accessory device(s) shown and/or described herein. As a result, electronic device 680 may be designed to hide at least some internal features of one or more of buttons 684*a*, 684*b*, and 684*c* that undergoes modifications for a button shown and/or described herein for an accessory device(s).

Various examples of aspects of the disclosure are described below as clauses for convenience. These are provided as examples, and do not limit the subject technology.

Clause A: An accessory device may include a sidewall. The accessory device may further include a button coupled with the sidewall. The button may include a first button surface, a second button surface opposite the first button surface, a first pillar extending from the second button surface, and a second pillar extending from the second button surface. The accessory device may further include a compressible member positioned between the first pillar and the second pillar.

Clause B: An accessory device may include a sidewall. The sidewall may include a first extension, and a second extension. The accessory device may further include a button coupled with the sidewall. The button may include a first pillar, a second pillar, and a third pillar. The first extension may positioned between the first pillar and the second pillar, and the second extension may be positioned between the second pillar and the third pillar.

Clause C: An accessory device may include a sidewall that includes a lip. The lip may include a first section at a first elevation, and a second section at a second elevation different from the first elevation. The accessory device may include a button coupled with the sidewall. The button may include a first surface, a second surface opposite the first surface, and an extension that extends from the second surface. The extension may align with the first section.

One or more of the above clauses can include one or more of the features described below. It is noted that any of the following clauses may be combined in any combination with each other, and placed into a respective independent clause, e.g., clause A, B, or C.

Clause 1: wherein: the sidewall includes a first opening and a second opening, and the first pillar and the second pillar are positioned in the first opening and the second opening, respectively.

Clause 2: wherein the sidewall includes: a first sidewall surface; and a second sidewall surface sub flush with respect to the first sidewall surface. The first opening and the second opening may be formed in the second sidewall surface.

Clause 3: further including a plate coupled with the button and the sidewall.

Clause 4: wherein: the second sidewall surface defines a lip, and the plate is coupled to the lip.

Clause 5: wherein the compressible member includes foam.

Clause 6: wherein: the first pillar includes a first rounded corner, the second pillar includes a second rounded corner, and the foam conforms to the first rounded corner and the second rounded corner.

Clause 7: further including a seal integrated with the button and extending from the second button surface. The button may include a first material, and the seal includes a second material different from the first material.

Clause 8: wherein the sidewall further includes: a first sidewall surface, and a second sidewall surface sub flush with respect to the first sidewall surface, wherein the first extension and the second extension extend from the second sidewall surface.

Clause 9: wherein: the sidewall includes a lip, and the button includes a ledge that at least partially covers the lip.

Clause 10: wherein: the sidewall further includes a standoff, and the standoff is perpendicular with respect to the lip.

Clause 11: further including: a first compressible member positioned between the first pillar and the second pillar; and a second compressible member positioned between the second and the third pillar.

Clause 12: wherein: the second pillar is positioned between the first pillar and the third pillar, the first pillar and the third pillar include a first size, and the second pillar includes a second size greater than the first size.

Clause 13: wherein actuation of the button causes the extension to move toward the first section.

Clause 14: wherein the button includes a light-absorbing coating.

Clause 15: wherein: the button further includes a pillar, and the light-absorbing coating is positioned on the pillar and the second surface.

Clause 16: further including a compressible member that conforms to the pillar.

Clause 17: further including a weld plate coupled to the button and the second section.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The predicate words "configured to", "operable to", and "programmed to" do not imply any particular tangible or intangible modification of a subject, but, rather, are intended to be used interchangeably. In one or more implementations, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

When an element is referred to herein as being "connected" or "coupled" to another element, it is to be understood that the elements can be directly connected to the other element, or have intervening elements present between the elements. In contrast, when an element is referred to as being "directly connected" or "directly coupled" to another element, it should be understood that no intervening elements are present in the "direct" connection between the elements. However, the existence of a direct connection does not exclude other connections, in which intervening elements may be present.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example, instance, or illustration". Any embodiment described herein as "exemplary" or as an "example" is not necessarily to be construed as preferred or advantageous over other embodiments. Furthermore, to the extent that the term "include", "have", or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more". Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

What is claimed is:

1. An accessory device, comprising;
a sidewall; and
a button coupled with the sidewall, the button comprising:
a first button surface,
a second button surface opposite the first button surface,
a first pillar extending from the second button surface, and
a second pillar extending from the second button surface; and
a compressible member positioned between the first pillar and the second pillar.

2. The accessory device of claim 1, wherein:
the sidewall comprises a first opening and a second opening, and
the first pillar and the second pillar are positioned in the first opening and the second opening, respectively.

3. The accessory device of claim 2, wherein the sidewall comprises:
a first sidewall surface; and
a second sidewall surface sub flush with respect to the first sidewall surface, wherein the first opening and the second opening are formed in the second sidewall surface.

4. The accessory device of claim 3, further comprising a plate coupled with the button and the sidewall.

5. The accessory device of claim 4, wherein:
the second sidewall surface defines a lip, and
the plate is coupled to the lip.

6. The accessory device of claim 1, wherein the compressible member comprises foam.

7. The accessory device of claim 6, wherein:
the first pillar comprises a first rounded corner,
the second pillar comprises a second rounded corner, and
the foam conforms to the first rounded corner and the second rounded corner.

8. The accessory device of claim 1, further comprising a seal integrated with the button and extending from the second button surface, wherein:
the button comprises a first material, and
the seal comprises a second material different from the first material.

9. An accessory device, comprising:
a sidewall comprising:
a first extension, and
a second extension; and
a button coupled with the sidewall, the button comprising:
a first pillar,
a second pillar, and
a third pillar,
wherein:
the first extension is positioned between the first pillar and the second pillar, and
the second extension is positioned between the second pillar and the third pillar.

10. The accessory device of claim 9, wherein the sidewall further comprises:
a first sidewall surface, and
a second sidewall surface sub flush with respect to the first sidewall surface, wherein the first extension and the second extension extend from the second sidewall surface.

11. The accessory device of claim 9, wherein:
the sidewall comprises a lip, and
the button comprises a ledge that at least partially covers the lip.

12. The accessory device of claim 11, wherein:
the sidewall further comprises a standoff, and
the standoff is perpendicular with respect to the lip.

13. The accessory device of claim 9, further comprising:
a first compressible member positioned between the first pillar and the second pillar; and
a second compressible member positioned between the second and the third pillar.

14. The accessory device of claim 9, wherein:
the second pillar is positioned between the first pillar and the third pillar,
the first pillar and the third pillar comprise a first size, and
the second pillar comprises a second size greater than the first size.

15. An accessory device, comprising:
a sidewall comprising a lip, wherein the lip comprises:
a first section at a first elevation, and
a second section at a second elevation different from the first elevation; and
a button coupled with the sidewall, the button comprising:
a first surface,
a second surface opposite the first surface, and
an extension that extends from the second surface, the extension aligned with the first section.

16. The accessory device of claim 15, wherein actuation of the button causes the extension to move toward the first section.

17. The accessory device of claim 15, wherein the button comprises a light-absorbing coating.

18. The accessory device of claim 17, wherein:
the button further comprises a pillar, and
the light-absorbing coating is positioned on the pillar and the second surface.

19. The accessory device of claim 18, further comprising a compressible member that conforms to the pillar.

20. The accessory device of claim 15, further comprising a weld plate coupled to the button and the second section.

* * * * *